United States Patent [19]

Davis

[11] Patent Number: 4,491,721

[45] Date of Patent: Jan. 1, 1985

[54] ELECTRIC BED HEATING DEVICE

[76] Inventor: Ralph A. Davis, 1820 W. Douglas, Suite 10,, Wichita, Kans. 67203

[21] Appl. No.: 385,518

[22] Filed: Jun. 7, 1982

Related U.S. Application Data

[63] Continuation-in-part of Ser. No. 141,379, Mar. 17, 1980, abandoned, and a continuation-in-part of Ser. No. 006,557, Jan. 25, 1979, abandoned.

[51] Int. Cl.[3] ..... A47C 21/04; F24H 3/00; H05B 3/00

[52] U.S. Cl. ..... 219/217; 5/284; 5/421; 128/376; 219/342; 219/347; 219/368; 219/376; 219/526

[58] Field of Search ..... 219/200, 201, 217, 342, 219/347, 349, 356, 358, 366–368, 374–376, 526, 536; 5/284, 421–423; 128/376, 377

[56] References Cited

U.S. PATENT DOCUMENTS

| | | | |
|---|---|---|---|
| 1,327,986 | 1/1920 | Clark et al. | 219/366 X |
| 1,396,241 | 11/1921 | Bakstad | 219/217 |
| 1,514,287 | 11/1924 | Hynes | 219/526 X |
| 1,531,519 | 3/1925 | Simmons | 219/366 |
| 1,936,960 | 11/1933 | Bowman | 219/217 X |
| 1,979,094 | 10/1934 | Blunt | 219/217 X |
| 2,256,049 | 9/1941 | Gallup | 219/347 X |
| 2,452,234 | 10/1948 | Gerdes | 219/342 X |
| 2,488,964 | 11/1949 | Conrad | 219/217 |
| 2,520,851 | 8/1950 | Myers et al. | 219/212 |
| 2,612,594 | 9/1952 | Schubert et al. | 219/356 |
| 3,646,319 | 2/1972 | Auld | 219/358 X |
| 4,064,387 | 12/1977 | McMullan | 219/217 |
| 4,146,776 | 3/1979 | Johansen | 219/342 X |

FOREIGN PATENT DOCUMENTS

| | | | |
|---|---|---|---|
| 10006 | 6/1928 | Australia | 219/347 |
| 734931 | 8/1955 | United Kingdom | 219/217 |

*Primary Examiner*—A. Bartis

[57] ABSTRACT

An electric bed heating device for attachment to the understructure of a bed for supplying heat to a sleeper includes an electric heating element mounted below a metallic plate thermally insulated on its upper side and having a lower face shaped to radially downwardly direct heat. In one embodiment the heating element is directly supported by vertical fins extending downwardly and radially outwardly from the lower face of the plate with the fins and heating element being exposed. In another arrangement a serially slit lower metallic plate is spaced below the first mentioned plate to allow flow of air therebetween. The lower plate supports an electric heating element in the path of the air flow. The slits in the lower plate form offset air inlet and outlet openings. The plates are aligned and attached to the bed structure by a central fastener binding the plates together. The upper face of the lower plate is roughened and blackened to enhance heat absorption. The device may be provided with a timer, thermostat or thermal fuse in circuit with the heating element for controlling operation of the heating element. In use the heating device distributes heated air across the underside of the bedding thereby creating temperatures above ambient in the area bounded by a vertical bed covering extending about the periphery of the bed and which restricts the heated air from flowing from beneath the bed.

3 Claims, 6 Drawing Figures

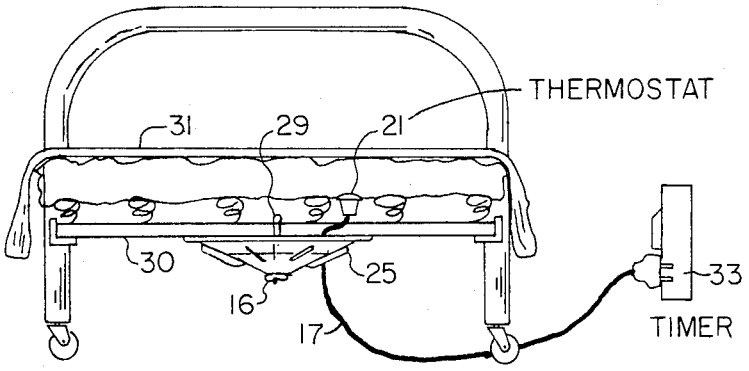
FIG. 1
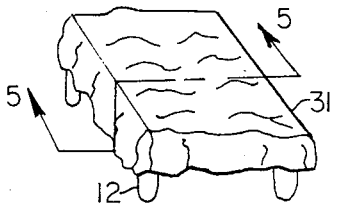
FIG. 2
FIG. 3
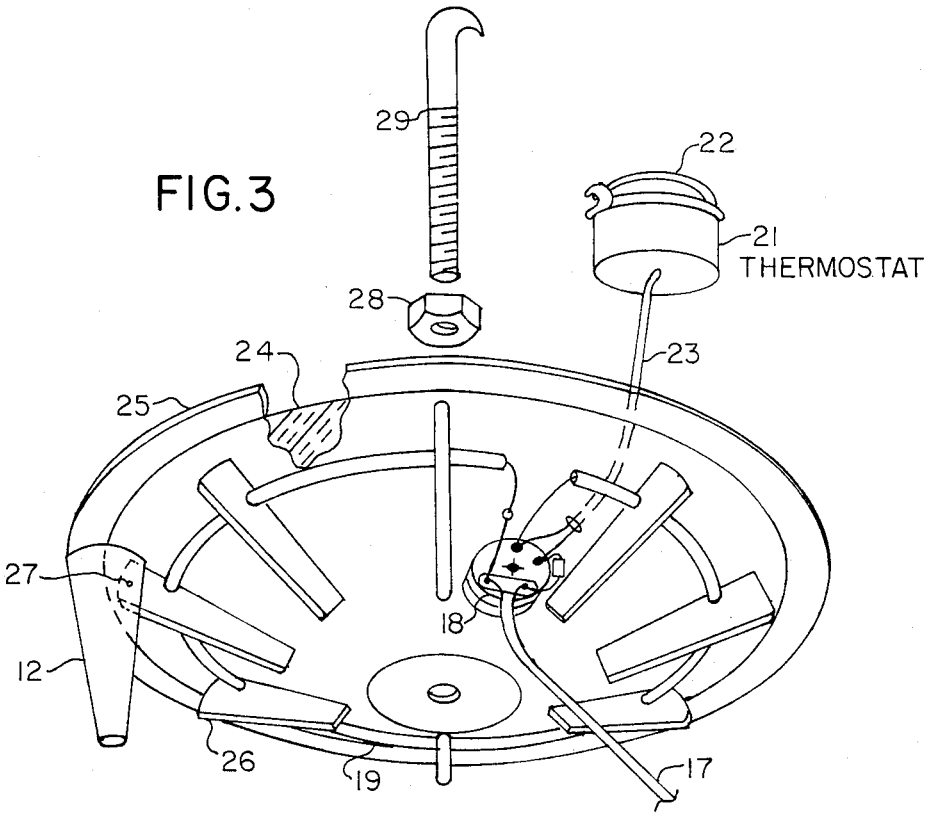

ELECTRIC BED HEATING DEVICE

CROSS-REFERENCES TO RELATED APPLICATIONS

This present application is a continuation-in-part of the applicant's earlier application Ser. No. 141,379, filed Mar. 17, 1980, now abandoned, which in turn is a continuation-in-part of his earlier abandoned application Ser. No. 006,557, filed Jan. 29, 1979.

This invention relates to new and useful improvements in heating for comfort and more particularly relates to applied heating for comfortable and healthy sleeping.

The primary object of this present invention is to enable a person or persons to sleep warm in the coldest of weather without wasting heat energy in other spaces of the dwelling.

Another object of the invention is to increase blood circulation so the living body can repair itself naturally during sleep and help prevent some cold weather ailments including hypothermia.

Another object of the invention is to provide a simple, safe and inexpensive means to bring comfort and health to many people, utilizing any cooler fresher air that may flow across the floor from outside and contain more oxygen than the inside room air.

One broad aspect of the invention involves utilizing the natural principles and movements resulting while heating air and using these functions to induce heat to where it can be used to advantage on the body with a minimum of waste. To accomplish this I have constructed an electric heating element into a suitable shape mounted between two metallic plates, an upper reflector plate and a lower plate which is perforated or louvered to enhance the flow of fresher air from the floor area. The unit is mounted beneath a bed and the air picks up heat by conduction from the plates which are heated by the element causing convection currents. The lighter heated air moves upwardly and outwardly to spread out on the underside of the bedding thereby raising the bed temperature above ambient room temperature. Some of my preliminary experiments showed me that the warm air can flow to the extreme edges of the mattress and be restricted by the overhanging blanket unitl penetrating into the bedding vertically. At 75° F. to 80° F. mattress temperature, a person lying on the mattress feels comfortably warm. No other type of heater that I know of is designed to apply heat so effectively in this manner. The heat is slow to pass through some mattresses and is stored therein for many hours. Also some mattresses are more porous and allow the heated fresher air from the floor to flow up through faster. While a person is effectively utilizing warmth and heat energy in a relatively small portion of the dwelling comfortably, he can simultaneously reduce room temperature and conserve energy.

Another aspect of the invention is its simplicity and inexpensiveness to manufacture and sell in quantities resulting in benefiting more people, since the upper and lower plates may be punched and formed on a standard power press and the other parts are mostly stock items. The upper plate is slightly conical and has an insulating material on its upper side, like asbestos insulating cement, to reduce any tendency to heat the bedding directly above it excessively. One or both of the plates are formed to prevent radiation escapage and to prevent any foreign objects from contacting the heating element if used for high heat output. A simple way to attach the unit to the bed understructure is with a central hooked fastener to tighten it in position. To regulate the heat for various requirements, a thermostat is installed under the mattress and a timer or photocell in the wall power source line can further control the heating periods.

Another aspect of the invention involves the versatility of the design. The upper plate can be attached to most any object or bed to be heated and has a heating element of modest wattage (AC or DC) bonded or cast into its structure which transmits heat by conduction into the air. When legs and lower slitted plate are attached, a hotter element of higher watts range can be used between the plates, since the radiation and reflected rays from the upper plate and element are captured and transmitted to the flowing air without any danger of scorching and igniting any material that may be nearby. This invention may also be adpated for use as a foot-stool, a bath tub heater, floor warmer or a chair warmer.

The objects and advantages of the invention are also described in conjunction with the accompanying drawings, wherein:

FIG. 1 is an end view of a bed showing the heating device installed, secured to the understructure thereto which may also be construed to represent other objects.

FIG. 2 is a perspective view of a padded foot stool or small bed wherein the heating device may be a part of the structure.

FIG. 3 is a perspective view of the upper plate with an optional heating element installation and related parts.

Figure 4:
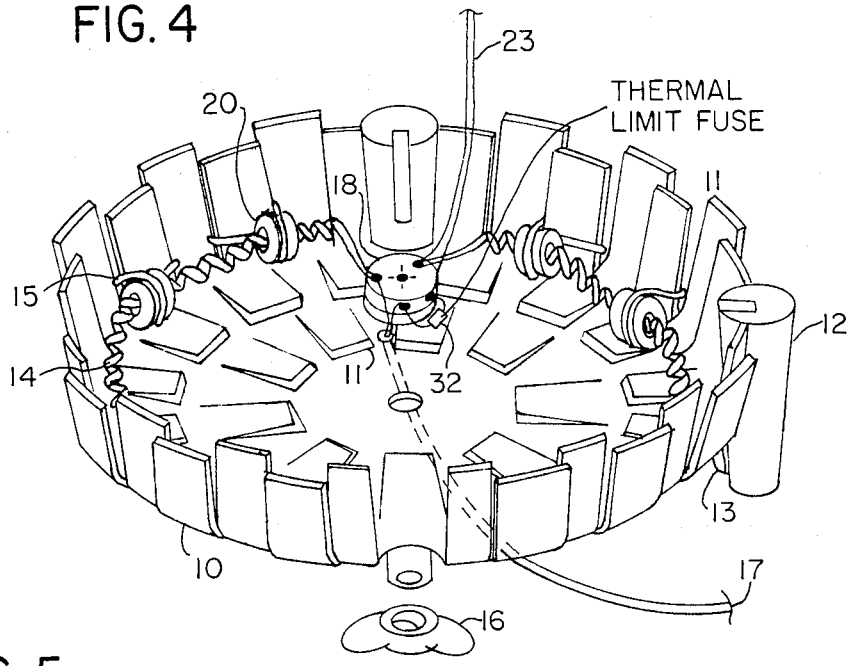
FIG. 4 is a perspective view of the lower plate and related parts.
Figure 5:
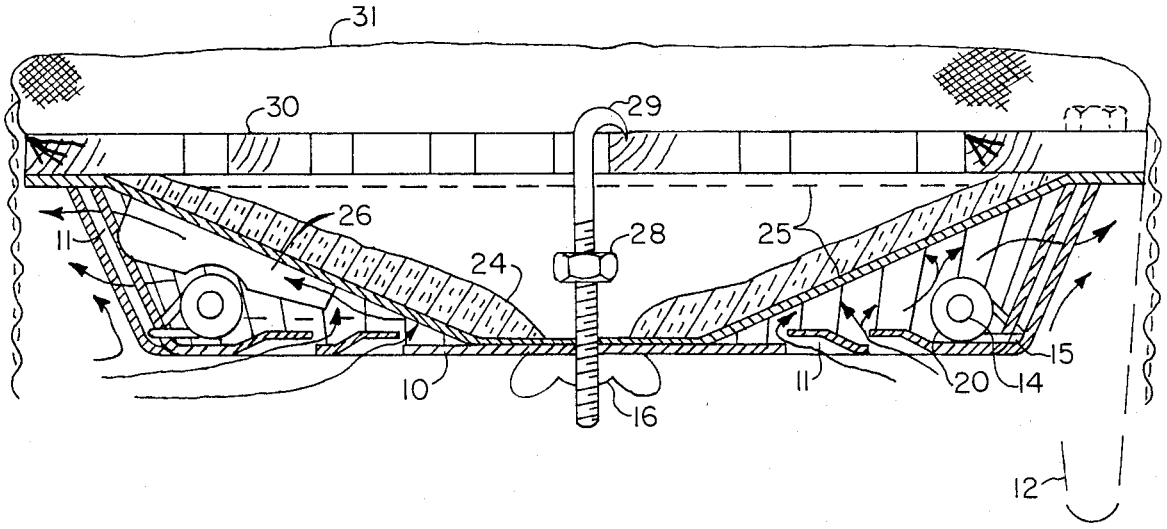
FIG. 5 is a cross section taken along line 5—5 of FIG. 2 showing the assembled heating device.
Figure 6:
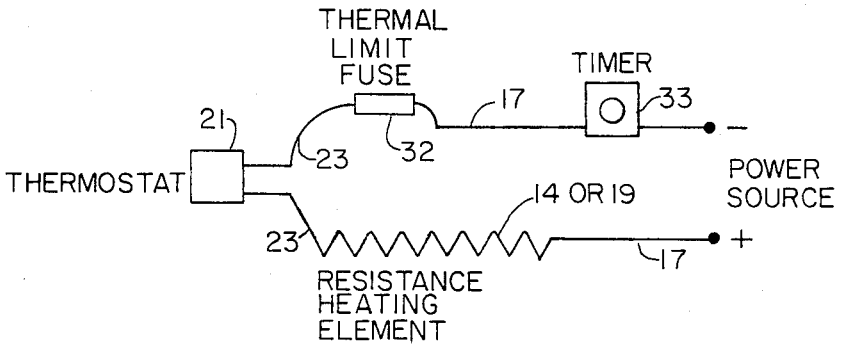
FIG. 6 is a circuit diagram showing the heating element controls.

Referring to the drawing, wherein is shown FIGS. 1, 2, 3, 4 and 5, the various parts of the invention are identified by numerals 10 through 33. Identical parts have identical numerals in each of the various Figures. The details of my invention will now be described. The lower plate 10 is metallic, the ideal radiator being rusty or oxidized iron coated with black stove polish, but since we are dealing with comparatively low temperatures and rapid heat transfer, a sandblasted aluminum is satisfactory, having a pitted surface to diffuse and absorb the heat rays. Also this rough surface conducts heat rapidly into the air on both sides. The inner surface being blackened assures greater absorbtion. The bottom plate 10 has flanges forming slits 11 to upwardly direct the air flow and expose maximum surface area to absorb the heat rays from the heating element 14 and the heat rays reflected from the upper metallic plate 25 with its polished surfaces. The slits in plate 10 can be described as being symmetrically punched offset openings without the removal of any material. The arrows in FIG. 5 indicate the flow of air through the plate 10 and into and out of the heating chamber between plates 10 and 25. Plates 10 and 25 engage together in the center and should also be in engagement on the outer edges. The upper reflector plate 25 with insulation 24 may be generally conical but also have fin surfaces 26 to aid in conducting heat into the air below it. FIGS. 3 and 4 show alternate types of heating elements 14 and 19. Suitable porcelain ceramic spool supports 20 with wire hangers 15 are shown in FIGS. 4 and 5 for supporting heating element 14. The element 19 may be incased and cast into plate 25 or bonded thereto if plate 25 is formed from sheet metal. The fins 26 may retain the heating element 19 (FIG. 3) or be recessed for clearance of the heating element 14 and supports 20 (FIG. 5). Electrical cord or cable 17 leads from an on-off timer 33 and a power source through a terminal block 18 into a series circuit including the heating element 14 or 19, a thermal limit fuse 32, a thermostat 21 and wire leads 23 as can be seen in FIG. 6. A wire clip 22 is one means of holding the thermostat 21 close to the bedding 31 area. The vertical spacers 12 shown in FIGS. 3 and 4 as being firmly attached to the fin surfaces 26 by pins 27 are optional. To strengthen the structure screws 13 may be employed. Welding is also a strong fastening method and could be used. The adjustable hooked fastener 29 ties the unit to the bed or object 30 and is tightened by wing nut 16 when nut 28 is loose as shown in FIG. 5. Nut 28 may be used in shipment, etc. Bedding 31 is the means to store and supply heat to the body and may be various forms; padding, mattress, blankets, sheets and overhanging coverings which trap the heat horizontally. Some beds have boxed in understructures of wood which serve to restrict the horizontal heat flow.

It is generally understood that materials, shapes and sizes may be modified within the spirit of the invention. Attention is now directed to the scope of the claims:

What I claim is:

1. In combination with a bed understructure and bedding thereon, a heating device comprising an upper thermally insulated matallic plate, an electric resistance heating element with support means, electric wiring and connections from said heating element leading to a thermal limit fuse, an electric power source for supplying power to said heating element, a lower flanged metallic plate slitted serially and disposed below and in spaced relation to the insulated plate, several vertical spacers firmly attached to the outer structure of the plates providing space for air movement through the lower plate; said heating element being mounted between said upper and lower plates in the path of said air movement: said slits of said lower plate forming offset air inlet and outlet openings; said plates being aligned and attachable to the bed understructure by means of a central fastener binding both plates together; said plates, slits and spacers being arranged generally symmetrical about a vertical central axis; said upper metallic plate being thermally insulated on its upper side but its metal being heat conductive and having a lower reflective surface shaped for reflecting heat downwardly and radially outwardly; said upper plate slanting generally upward and outward from said axis with several elongated protrusion surfaces extended downward from said lower surface thereof for receiving and fastening said vertical spacers near the periphery of the plate; said protrusions being recessed to avoid said heating element; said support means for said heating elememt being attached to the upper surface of said lower plate; said lower plate being shaped and roughened in a manner to provide a substantial surface exposure to absorb heat rays from said heating element and conduct heat to air, the temperature being limited by the thermal fuse; both plates and heating element cooperating to create convection currents upwardly and radially outward between said plates to distribute heated fresher air consistently across the underside of the bedding whereby air temperature above ambient can be created in the area bounded by a vertical bed covering extending about the periphery of the bed and which restricts the heated air from flowing horizontally from beneath the bed into the ambient air, thereby causing a storage of a limited amount of heat underneath and within the bedding from which a living body lying thereon receives warmth and comfort.

2. In combination with a bed understructure and bedding thereon, a heating device comprising a thermally insulated metallic plate supporting an electric resistance heating element in thermally conductive relationship with the lower face thereof, electric connections and wiring from said heating element leading to a suitable on-off timing control device and subsequently to an electrical power source for supplying power to said heating element; said plate disposed generally horizontally with said heating element facing downwardly and attached to the bed understructure by means of a central fastener; said plate being thermally insulated on its upper side and having its heat conductive lower surface shaped sloping upwardly from the center outward radially; said plate having several elongated vertical fin surfaces extending downwardly and radially from the lower surface of said plate; said plate and fins engaging and supporting the heating element on the lower surface, the engagement of said heating element with said fins providing for conductive heat transfer into the air and urging air movements divergently to distribute heated fresher air consistantly across the underside of the bedding, whereby air temperatures above ambient can be created in the area bounded by a vertical bed covering extending about the periphery of the bed and which restricts the heated air from flowing horizontally from beneath the bed into the ambient air thereby causing a storage of periodically supplied heat underneath and within the bedding from which a living body lying thereon receives warmth and comfort.

3. In combination with a bed understructure and bedding thereon, a heating device comprising an upper thermally insulated metallic plate, an electric resistance heating element with support means, electric connections and wiring from said heating element in circuit with a suitable thermostatic control device and subsequently to an electrical power source for supplying power to said heating element, a lower metallic plate serially slitted and disposed and attached below the upper plate and providing space for air movement between the two plates; said heating element being supported by said support means in the path of the air flow between said plates; said slits in said lower plate forming offset air inlet and outlet openings; said plates being aligned and attached to the bed understructure by means of a central fastener binding both plates together; said plates and openings being arranged generally symmetrically about a central vertical axis; said upper plate being thermally insulated on its upper side and having a lower reflective surface shaped for reflecting heat downwardly and radially outwardly; said upper plate slanting generally upward and outward from said axis; said support means for said heating element being attached to the upper surface of said lower plate, said lower plate being shaped and roughened in a manner to provide a substantial surface exposure to absorb heat rays from the said heating element and to conduct heat to air; both plates and heating element cooperating to create convection currents upward and radially outward between said plates to distribute heat and fresher air consistantly across the underside of the bedding whereby air temperatures above ambient can be created in the area bounded by a verticl covering extending about the periphery of the bed and which restricts the heated air from flowing horizontally from beneath the bed into the ambient air thereby causing a storage of thermostatically regulated heat underneath and within the bedding from which a living body lying therein receives warmth and comfort.

* * * * *